US005186721A

United States Patent [19]

Campana

[11] Patent Number: 5,186,721

[45] Date of Patent: Feb. 16, 1993

[54] FUEL PACKAGE

[75] Inventor: Patsie C. Campana, Lorain, Ohio

[73] Assignee: Caldo International, Inc., Lorain, Ohio

[21] Appl. No.: 810,706

[22] Filed: Dec. 18, 1991

[51] Int. Cl.[5] ..... C10L 11/06

[52] U.S. Cl. ..... 44/519; 44/531; 44/532; 44/533; 44/534

[58] Field of Search ..... 44/530, 531, 532, 533, 44/534, 519; 229/244, 217

[56] References Cited

U.S. PATENT DOCUMENTS

| | | | |
|---|---|---|---|
| Re. 26,107 | 11/1966 | Rasmussen et al. | 229/244 |
| 1,401,803 | 12/1921 | Lynes . | |
| 2,548,379 | 4/1951 | Lammersen | 44/40 |
| 2,666,695 | 1/1954 | Brody | 44/40 |
| 2,834,661 | 5/1958 | Chaplin | 44/40 |
| 3,022,931 | 2/1962 | Guyer | 229/244 |
| 3,056,665 | 10/1962 | Linda et al. | 44/532 |
| 3,252,770 | 5/1966 | Fearon | 44/40 |
| 3,269,807 | 8/1966 | Key, Jr. | 44/40 |
| 3,302,857 | 2/1967 | Martin | 229/244 |
| 4,013,061 | 3/1977 | Trumble et al. | 126/263 |
| 4,074,977 | 2/1978 | Dunham et al. | 44/38 |
| 4,101,292 | 7/1978 | Hogan, II | 44/40 |
| 4,460,377 | 7/1984 | Kalil | 44/40 |
| 4,762,525 | 8/1988 | Wood | 44/533 |
| 4,832,703 | 5/1989 | Campana et al. | 44/519 |

FOREIGN PATENT DOCUMENTS 1957368 5/1971 Fed. Rep. of Germany .

*Primary Examiner*—Jacqueline Howard
*Attorney, Agent, or Firm*—Fay, Sharpe, Beall, Fagan, Minnich & McKee

[57] ABSTRACT

A self-kindling fuel package comprises a combustible container having four planar side walls, a bottom wall, and a top wall. The container is constructed from a single planar element which is then folded to create the container. The container receives fuel, an ignitor, and a wick. Openings are provided in the walls of the container to aid in ventilation and drafting. A pull tab in the top wall of the container is selectively displaceable to aid in a "chimney" effect.

26 Claims, 4 Drawing Sheets

FUEL PACKAGE

BACKGROUND OF THE INVENTION

I. Field of Invention

This invention pertains to the art of fuel packages, and, more particularly, to an improved fuel package wherein the fuel and ignitor are held within a combustible, low cost package which keeps the user's hands free from residue.

II. Description of the Related Art

The use of charcoal briquettes and similar fuels for outdoor cooking is well-known. Typically, one wishing to cook outdoors purchased charcoal and charcoal lighter fluid in combination. The charcoal in such bags is typically more than is required for a single use by a single family. As such, bags are relatively large and heavy, and often coat the user with a layer of charcoal dust. The charcoal is often difficult to kindle, even when using lighter fluid. Conventional charcoal lighter fluid, being a liquid, can be somewhat volatile and can present safety and fire hazards.

Typical lighter fluid operates by soaking into the briquettes. Upon ignition, the fluid burns away and the charcoal smolders until hot enough to provide proper heat for cooking. Generally, the procedure takes more time than is desired.

To alleviate these and other problems, some self-kindling fuel packages have been sold. For example, U.S. Pat. No. 4,832,703 to Campana, et al. describes one such self-kindling fuel package in which a charge of fuel is held together within a container. The container is comprised of two elements which are folded together to create the container which receives the fuel.

Another example of a fuel package is U.S. Pat. No. 3,269,807 to Key, Jr., in which the fuel package comprises a basket formed of a plurality of staves. Within the staves is loaded a charge of fuel. The top of the basket is covered with a circular lid which features a tab.

Another example of a fuel package is U.S. Pat. No. 1,401,803 to Lynes in which a wick extends without a box-like structure containing inflammable material.

U.S. Pat. No. 2,834,661 to Chaplin discloses a self-kindling fuel package featuring a chimney section in the middle.

Finally, U.S. Pat. No. 4,460,377 to Kalil features a hollow cardboard container in which charcoal or another similar fuel is stored and ignited with an ignitor.

SUMMARY OF THE INVENTION

In accordance with the present invention, a new and improved self-kindling fuel package is provided.

More particularly, in accordance with the present invention, the package comprises a container which is comprised of a plurality of planar surfaces. The container has a top end and a bottom end. The top end comprises a first flap. The first flap comprises a pull tab which is selectively displaceable. The container contains a charge of fuel within the container and igniting means for igniting the charge of fuel.

In accordance with another aspect of the invention, the pull tab is selectively displaceable between a first and second position. The first position is in the plane of the first flap and the second position is outside the plane of the first flap.

The top end of the container further comprises second, third, and fourth flaps, each of which has an edge corresponding to an edge of one of the container side walls. The flaps are selectively foldably rotatable about their respective edges to selectively form at least a portion of the top wall of the container.

According to another aspect of the present invention, slots are located in the third and fourth flaps and are positioned under the pull tab when the third and fourth flaps are folded inwardly under the first flap.

According to another aspect of the present invention, the container comprises venting means for ventilating an interior of the container, the venting means located in the side walls near the bottom wall.

According to a still further aspect of the invention, the container comprises a plurality of planar surfaces which comprise a single continuous element. The plurality of planar surfaces are formed by folding the larger continuous element into the various planar surfaces.

One advantage of the present invention is the provision of a new and improved fuel package capable of use in any of the ordinary types of non-gas, non-electric barbecue grills such as fireplaces, wood stoves, campfires, and the like.

Another advantage of the present invention is the provision of a fuel package which is clean, easily handled, kindles rapidly, and contains a charge of a fuel commonly sufficient for a single use.

Still another advantage of the present invention is the provision of a fuel package which eliminates the necessity for the user to handle the charcoal, thereby allowing the user to avoid soiling his hands.

Another advantage of the present invention is the provision of a solid igniting material, obviating the necessity for the user to utilize volatile liquid lighter fluid.

A further advantage of the present invention is the provision of a fuel package which uses an inorganic ignitor for hot burning, so as to readily kindle a fire in the fuel contained in the package and provide a higher cooking temperature.

A yet further advantage of the present invention is the provision of a self-kindling fuel package in which a measured charge of charcoal is contained within an inexpensive, clean, combustible container. The container features planar surfaces which are suitable to receive advertising and which facilitate efficient stacking, storage, and conservation of shelf space.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
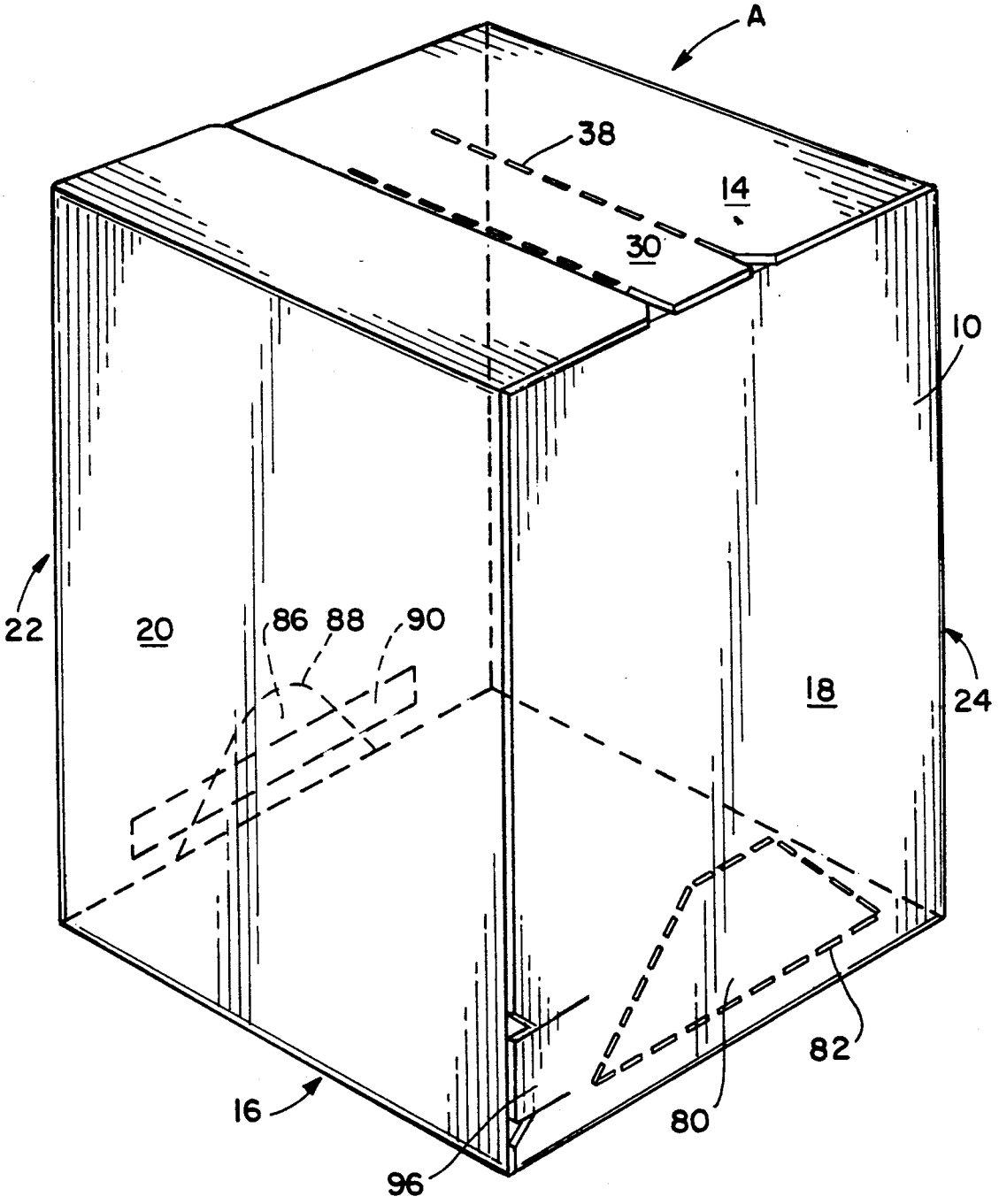
FIG. 1 is a perspective view of a self-kindling fuel package according to the present invention.

Referring now to the drawings, wherein the showings are for purposes of illustrating a preferred embodiment of this invention only and not for purposes of limiting the same, FIG. 1 shows the subject new fuel package A. While the fuel package A is primarily designed for and will hereinafter be described in connection with its use on a barbecue grill for kindling a charcoal fire thereon, it will be appreciated that the overall inventive concept involved could be adapted for use in other environments where it is desired to start a fire such as in a wood stove, a fireplace, or a campfire.

Figure 6:
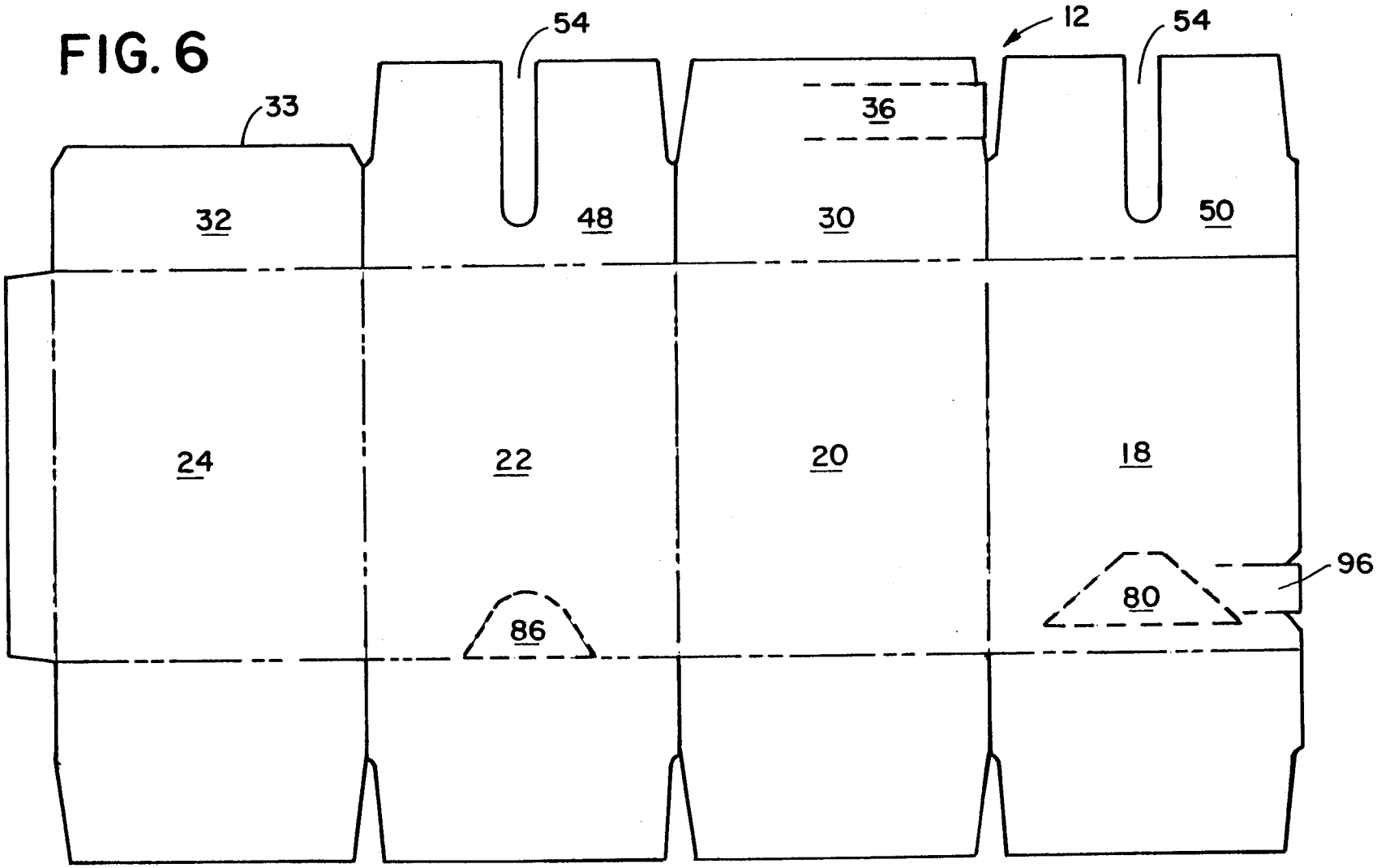

With reference to FIGS. 1 and 6, the container 10 is comprised of a plurality of planar surfaces. The container 10 is preferably made of a flat, continuous element 12. In the preferred embodiment, the planar surfaces are generally rectangular and comprise a top wall 14, a bottom wall 16, and four side surfaces 18, 20, 22, and 24. In the preferred embodiment, the top wall 14 and the bottom wall 16 are approximately square and the side walls 18, 20, 22, 24 are the same size and are taller than their width. This configuration assists in uniformly heating the fuel within the container 10. For example, because the height of the side walls 18, 20, 22, 24 is greater than the width, the fuel tends to be stacked in a pillar-like arrangement. Such an arrangement helps heat a large number of the fuel briquettes quickly in that heat tends to rise. Additionally, because the width of each side wall is approximately equal, the arrangement of the fuel briquettes within the container 10 tends to be symmetrical about a longitudinal axis passing through the center of the top wall 14 and bottom wall 16. As the briquettes burn the container 10 away, the briquettes tend to fall in a uniform symmetrical pattern conducive for uniform heating and ease of cooking.

Figure 2:
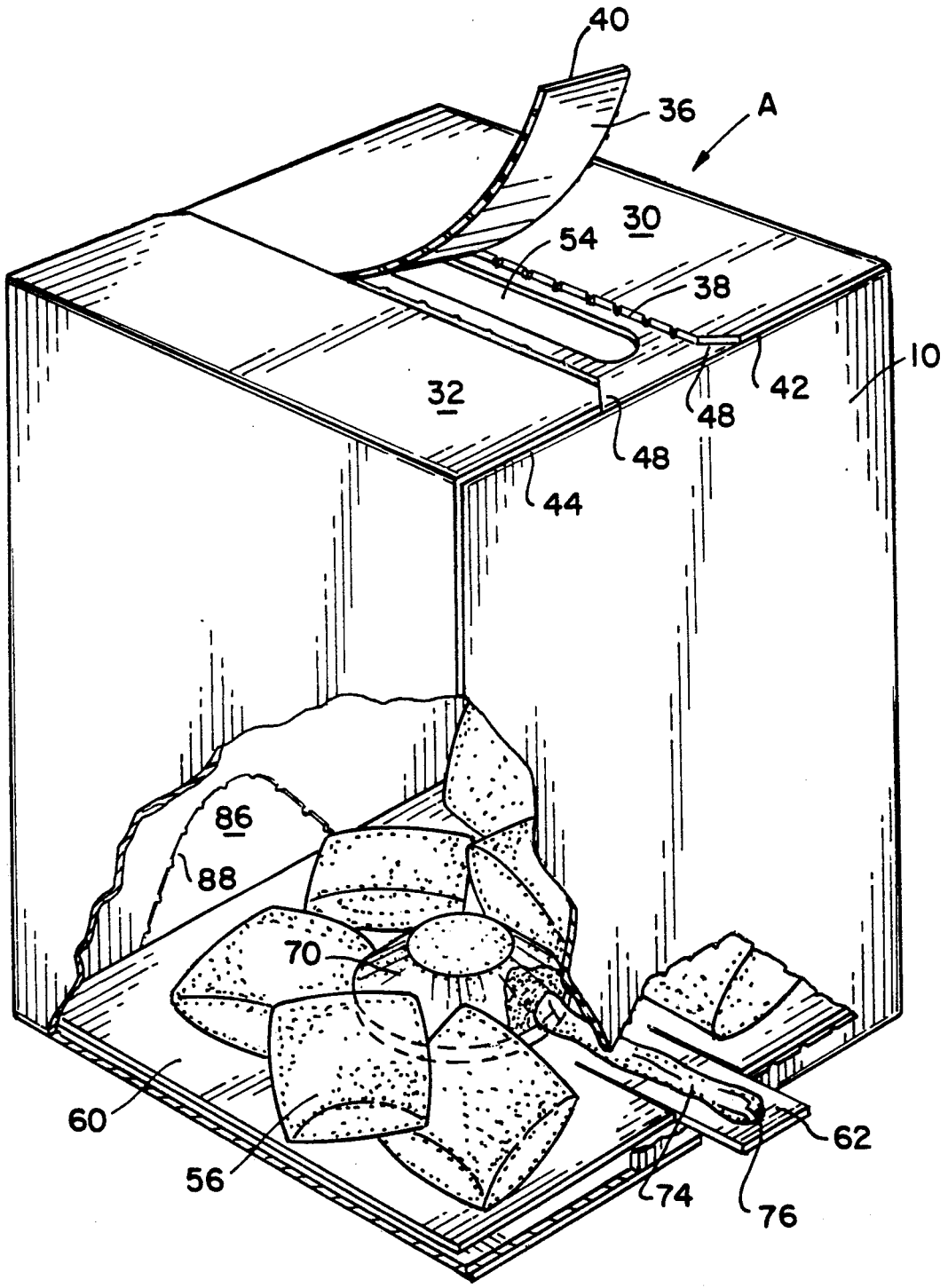
FIG. 2 is a perspective view, partially broken away, of a self-kindling fuel package showing fuel, ignitor, wick, and the pull tab in an operative position.

With reference to FIGS. 2 and 6, the top wall 14 is shown to comprise a first flap 30 and a second flap 32. As will be discussed later in the specification, the flaps are selectively folded together to comprise the top wall 14. The first flap 30 comprises a pull tab 36. The pull tab has edges 38 which are perforated to enable the pull tab to be torn open and lifted out of the plane of the first flap 30. A first end 40 of the pull tab 36 is located near an edge 42 of the first flap 30 and an edge 44 of the second flap 32. At both of these edges 42, 44, the corner has been cut at a bevel 48 to assist in the user gripping the first end 40 of the pull tab 36. The second flap 32 is shorter than the first flap 30, so that the edge 33 of the second flap 32 does not extend beneath pull tab 36.

With continuing reference to FIGS. 2 and 6, the container 10 is shown in a flattened, unfolded state. In addition to the first and second flaps 30, 32 of the top wall 14, there is illustrated third and fourth flaps 48, 50. When the first, second, third, and fourth flaps are folded together to comprise top wall 14, a slot 54 is located directly beneath pull tab 36. One half of the slot 54 is cut into the third flap 48 and one half of the slot 54 is cut into the fourth flap 50. The slot 54 provides ventilation at the top of the container 10 when the briquettes have been ignited and provides a drafting, chimney-like effect.

With continuing reference to FIG. 2, the fuel 56 is illustrated in the form of charcoal briquettes. While charcoal briquettes are the preferred fuel, other types of fuel can work equally as well. A larger number of charcoal briquettes are normally placed into the container 10 than is shown in FIG. 2; a smaller number is shown for purposes of clarity.

Figure 3:
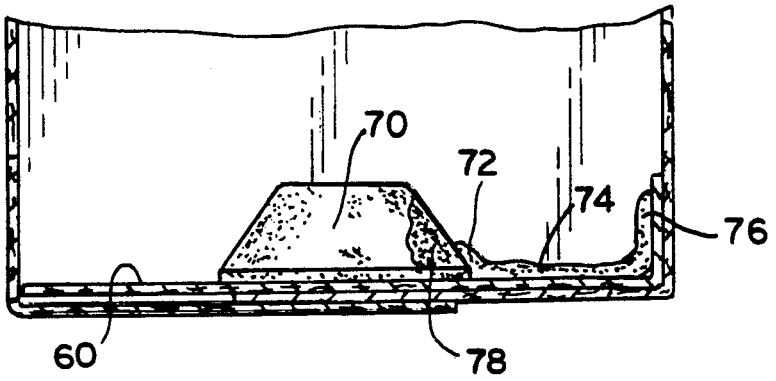
FIG. 3 is a side elevational cross-sectional view of the bottom wall, ignitor, and wick of a fuel package according to the invention.
Figure 4:
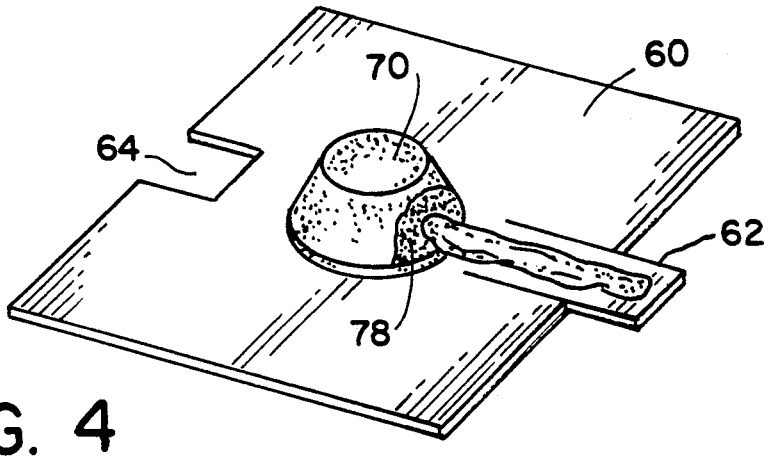
FIG. 4 is a perspective view of a floor insert, ignitor, and wick according to the invention.

With reference to FIGS. 2–4, the preferred embodiment of the fuel package A contains a floor insert 60. The floor insert 60 is received within the container 10 and is designed to fit on top of bottom wall 16. The floor insert 60 is cut with an extension 62 as well as a recess 64. The function of the extension 62 is to extend the wick beyond the confines of the container 10 as will be discussed later. The function of the recess 64 is to enable the extension 62 to be stamped out of an adjoining piece of cardboard with maximum material savings. For example, a large number of floor inserts 60 can be stamped out of a single rectangular piece of cardboard with minimal waste if the extension 62 of one floor insert 60 creates the recess 64 of the adjoining floor insert 60.

It is not believed that a floor insert so is required; instead, it may be preferable to place the fuel, ignitor, and wick directly on the bottom wall 16 of the container 10. On the other hand, some manufacturing efficiencies may result from use of the floor insert 60. For example, the wick and ignitor may be inconveniently placed directly on the bottom wall 16.

With continuing reference to FIGS. 2–4, an ignitor 70 is placed in the center of the floor insert 60. The chemical composition of the ignitor 70 will be discussed in more detail later in the specification, but its primary function is to ignite the fuel 56.

A first end 72 of a wick 74 is attached to the ignitor 70. The wick 74 is generally centered on the extension 62. The wick 74 can be extruded from a mixture of its various components or, if desired, it can be formed by mixing it with or impregnating it into a suitable carrier. Typical acceptable carrier materials include cotton, materials such as the strands of a floor mop, paper fabrics such as in paper towels, and paper materials impregnated with candle wax.

In the preferred embodiment, an ignition cream 78 may be used to attach the wick 74 to the ignitor 70 and to the extension 62. In a preferred embodiment, the wick 74 and the ignition cream 78 have the same composition. The requirements of the wick 74 and ignition cream 78 are generally that they are ignitable with a match or a cigarette lighter, they are wind resistant, and they have sufficient heat generation ability so as to ignite the ignitor material 70. A special requirement of the wick 74 is that it will flex without breaking, i.e., it must evidence a high degree of flexibility. The ignition cream 78 is typically applied to a thickness of approximately 2 millimeters or thicker. One preferred embodiment of ignition cream 78 was composed of ten grams Fe, ten grams Al, ten grams Si, sixty grams $KClO_4$, and thirty grams polyurethane resin binder, if desired. The Fe and Si can be added in the form of a ferrosilicon alloy. The polyurethane resin binder is preferably dissolved in hexane or hexane mixed with heptane. A presently preferred composition includes ten grams Al, twenty grams Fe, ten grams Si, forty grams $KClO_4$, and thirty grams of a polyurethane binder.

When the container 10 is packaged for shipping, such as when it is on the shelf of a store, a second end 76 of the wick is folded, along with the extension 62, within the container 10, as is shown in FIG. 3. It is this folding which makes the requirement of flexibility necessary. When the fuel package A is ready for ignition, the extension 62, along with the second end 76 of the wick 74 is pulled outwardly through an opening 80 in the side wall 18 of the container 10. The opening 80 is created by removing or deflecting a portion of the side wall 18 defined by a series of perforations 82.

A second opening 86 is located in the side wall 22 on the opposite side of the first opening 80. The second opening 86 is also created be removing or deflecting a portion of side wall 22 via the use of a series of perforations 88 in that side wall 22. In one embodiment of the invention, a strip of common adhesive tape 90 is used to keep the second opening 86 closed until the fuel package A is to be used. In a second embodiment, a second tab 96 is formed into side wall 18 to facilitate the opening of the first opening 80, similar to the opening of the pull tab 36 in the top wall 14.

Figure 5:
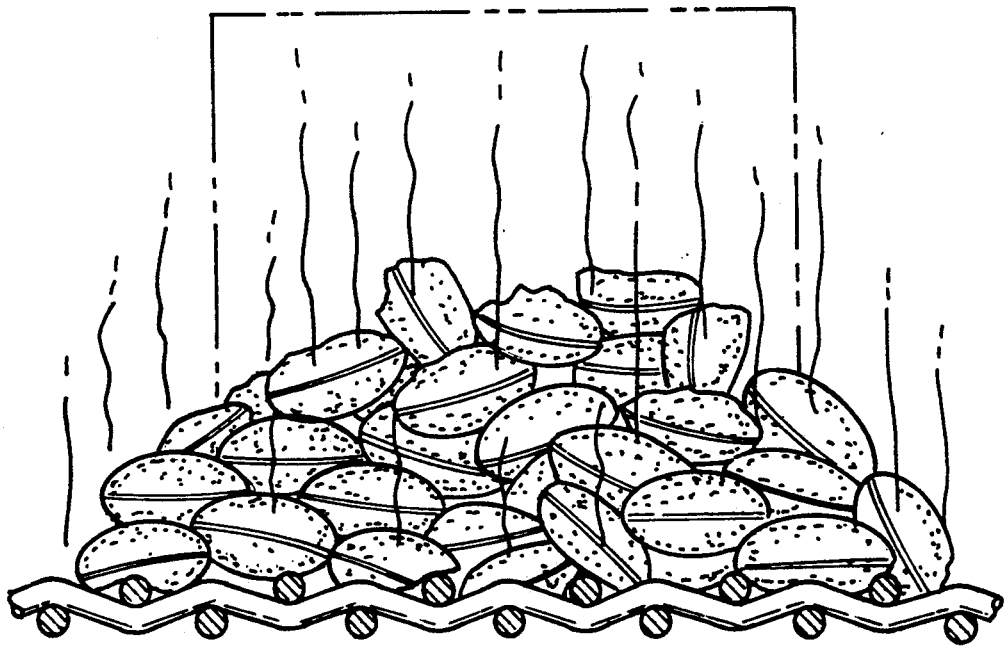
FIG. 5 is a side elevational view of the fuel package of FIG. 1 after the container has been completely consumed, the container itself being shown in phantom lines as it existed before it was ignited; and, FIG. 6 is a top plan view of a container according to the present invention in its unfolded state.

With reference to FIGS. 1, 2, and 5, the operation of the fuel package A is as follows: after the fuel package A is placed in an appropriate container, such as a charcoal grill, the pull tab 36 is deflected upwardly so that the perforated edges 38 tear. The pull tab 36 is deflected so that it stays in a second position, deflected from the plane of the top wall 14. This allows the slot 54 to be exposed. By exposing the slot 54, the fuel 56 is also exposed to the outside air. The slot 54 creates, in conjunction with first and second openings 80, 86, a draft which contributes to the quick ignition and burning of the fuel 56.

Next, the first opening 80 is opened, either by means of second tab 96 or by perforations 82. Upon removing or deflecting the portion of side wall 18 covering first opening 80, extension 62 and the second end 76 of the wick 74 are easily folded downwardly and outwardly of the container. After opening the second opening 86 in a similar fashion, the second end 76 of wick 74 can be ignited by a conventional match or cigarette lighter. The wick 74 burns in a steady and controllable fashion until it reaches the ignitor 70. At this point, the ignitor 70 ignites, creating a point of intense heat sufficient to ignite the fuel 56. The fuel 56 burns within the container 10 until the combustible container 10 material is consumed. When the container 10 has lost its structural rigidity, the fuel briquettes 56 tend to tumble into a generally symmetrical pattern conducive for heat transfer and good cooking performance. This arrangement is illustrated in FIG. 5.

Next, the composition of the ignitor 70 and the wick 74 will be discussed.

The ignitor 70 is fabricated from a special mixture of materials which include in weight percent from about 25% to 65% silica, from about 5% to 18% sodium nitrate, from about 1% to about 8% sodium hexafluorosilicate or cryolite, from about 15% to about 40% aluminum, and from about 2% to about 20% iron oxide.

The ignitor 70 is produced from a thermite type of material ($2Al+Fe_2O_3 \rightarrow Al_2O_3+2Fe$) to which has been added various other materials for the purpose of controlling the rate of the thermite reaction. In this regard, the above-described formulation results in an ignitor 70 which is exceptionally well-suited for the practice of the instant invention. In the proper circumstances, it may be possible to control the rate of the thermite reaction by using materials other than those specified above. For example, various clays or charcoal may be substituted for the silica. The individual components which make up the ignitor 70 are mixed together with a suitable binder, such as sodium silicate, and formed into the desired configuration by conventional means. The preferred composition used as the ignitor 70 comprises, in weight percent, about 50% silica, about 12% sodium nitrate, about 4% sodium hexafluorosilicate, about 29% aluminum and about 5% iron oxide.

The particle size of the various components of the ignitor 70 are selected so that upon ignition, the ignitor 70 burns ar a relatively slow rate, generally at a rate about 1 inch per 40 seconds. In the practice of the present invention, a burning rate of from about 5 to 60 seconds per inch is desirable with excellent results being achieved when the burning rate ranges from about 30 to 50 seconds per inch.

The particle size of the silica is such that at least 90% passes through a 20 mesh Tyler screen. In practice, the silica component is made up of two different mixes of silica particles. For example, a typical silica formulation comprises 90% of type A silica (as defined below) and 10% of type B silica (as defined below).

Type A silica

About 0.8–1% retained on a 20 mesh screen
About 27% retained on a 30 mesh screen
About 62% retained on a 40 mesh screen
About 10% retained on a 50 mesh screen
About 0.2% retained on a 70 mesh screen
About trace retained on a 100 mesh screen
About trace retained on a 140 mesh screen Type B Silica About 0.3% retained on a 20 mesh screen
About 5.8% retained on a 30 mesh screen
About 21.4% retained on a 40 mesh screen
About 44.8% retained on a 50 mesh screen
About 21.5% retained on a 70 mesh screen
About 3.8% retained on a 100 mesh screen
About 1.6% retained on a 140 mesh screen
About 0.8% retained on a 200 mesh screen Both the sodium nitrate and the sodium hexafluorosilicate are sized such that they essentially all pass through an 80 mesh screen.

The iron powder is usually sized such that it passes through a 100 mesh screen.

The aluminum powder is sized such that it has a particle size ranging from about 0.01 to about 1.0 mm.

The various components of the ignitor 70 are mixed together and formed into the desired shape using a suitable binder. A typical binder is sodium silicate.

The ignition temperature of the ignitor 70 is in the range of about 1500° F. to about 2000° F. The preferred temperature is about 1750° F. Upon ignition, the ignitor 70 produces a temperature of about 2750° F. By utilizing an ignitor 70 of this type, it is possible to efficiently ignite a fuel such as charcoal, which is used for the purposes hereinbefore described.

In practice, the wick and ignition cream are generally composed of the same materials in the same relative amounts will ignite at a low temperature such as that generated by a match. Their most important feature is that then is applied to at least a portion of the surface of the ignitor 70. A typical ignition cream comprises a mixture, in weight percent, of from about 10% to about 40% of an oxidizer, such as potassium nitrate ($KNO_3$), sodium nitrate ($NaNO_3$), manganese dioxide or the like, potassium perchlorate ($KClO_4$), potassium chlorate ($KClO_3$), from about 5% to about 30% aluminum, from about 10% to about 40% iron, from about 5% to about 40% silicon together with a suitable binder, such as from about 10% to about 40% polyurethane resin in a water emulsion or organic solvent.

The oxidizer is preferably employed in an amount ranging between about 30 to about 60 percent of stoichiometric (based on the amount of metal present). In practice, the preferred oxidizer is potassium perchlorate.

The metallic components are preferable utilized in powdered form. In this regard, it is preferred to use atomized aluminum, and powdered iron and silicon or tenosilicon alloy.

The preferred binder is polyurethane, but other binders which may be employed include, acrylic emulsions, acrylic solutions with organic solvents, carboxymethyl cellulose, hydroxypropyl cellulose, hydroxyethel cellulose, polyvinyl alcohol, polysulfide, silicones, polyethyloxazoline, polyvinyl acetate, and polyamide resin. The ignition cream will preferably be ignited at a temperature of from about 500° F. to about 1000° F. and generate from about 2000° F. to about 3000° F. when burning. In one preferred embodiment, the ignition cream is ignited by a match flame and burns at a temperature sufficiently high to ignite thermite-like mixtures.

In addition to aiding ignition of the ignitor 70, the ignition cream 78 can serve to bond the wick 74 to the ignitor 70 and to the extension 62.

The fuel package A shown in the FIGURES is approximately sized for a single family use, such as a family barbecue. Different sizes of fuel packages A can be easily manufactured, such as for a larger party. On the other hand, a plurality of single family, single use fuel packages A can be grouped into a larger pit.

The invention has been described with reference to a preferred embodiment. Obviously, alterations and modifications will occur to others upon a reading and understanding of this specification. It is intended to include all such modifications and alterations insofar as they come within the scope of the appended claims or the equivalents thereof.

Having thus described the invention, it is now claimed:

1. A fuel package comprising:

a container, said container being comprised of a plurality of planar surfaces, said container having a top wall and a bottom wall, said top wall comprising a first flap, said first flap comprising a pull tab which is selectively displaceable between a first and second position, said first position being in the plane of said first flap and said second position being outside the plane of said first flap, said tab being selectively rotatable from said first position to said second position about a side of said tab, said rotation to said second position effective to expose a slot, said slot adapted to pass byproducts of combustion outwardly from said container;

a charge of fuel within said container; and, igniting means for igniting said charge of fuel, said igniting means positioned within said container.

2. The fuel package of claim 1 further comprising:

a second flap comprising said top wall of said container, said second flap comprising said slot, said slot selectively located beneath said pull tab.

3. The fuel package of claim 1 wherein said container comprises four side walls, said container further comprising:

second, third, and fourth flaps, each flap having an edge which corresponds to an edge of one of said container side walls, said flaps selectively rotatable about its respective edge to selectively form at least a portion of said top wall of said container.

4. The fuel package of claim 3 further comprising:

slots located in said third and fourth flaps, said slots positioned under said pull tab when said third and fourth flaps are folded inwardly under said first flap.

5. The fuel package of claim 1 wherein said igniting means for igniting comprises:

an ignition element; and, a wick, said wick having a first end and a second end, said first end of said wick secured to said ignition element and said second end extending outside said container.

6. A fuel package container for containing a charge of fuel and a kindling material, said container comprising:

side walls, a bottom wall and a top wall, said top wall comprising a first flap having a pull tab, said pull tab being selectively displaceable between a first and second position, said first position being in the plane of said first flap and said second position being outside the plane of said first flap, said tab being selectively rotatable from said first position to said second position about a side of said tab, said rotation of said second position effective to expose a slot, said slot adapted to pass byproducts of combustion outwardly from said container.

7. The container of claim 6 further comprising:

a second flap comprising said top wall of said container, said second flap comprising said slot, said slot selectively located beneath said pull tab.

8. The container of claim 6 wherein said container comprises four side walls, said container further comprising:

second, third, and fourth flaps, each flap having an edge which corresponds to an edge of one of said container side walls, each of said flaps selectively rotatable about its respective said edge to selectively form at least a portion of said top wall of said container.

9. The container of claim 8 further comprising:

slots located in said third and fourth flaps, said slots positioned under said pull tab when said third and fourth flaps are folded inwardly under said first flap.

10. The container of claim 6 wherein the height of each side wall is greater than its width.

11. The container of claim 6 wherein the dimensions of each side wall are substantially identical to the dimensions of the other side walls.

12. The container of claim 6 further comprising:

venting means for ventilating an interior of said container, said venting means located in one of said side walls near said bottom wall.

13. The container of claim 12 wherein said venting means comprises orifices having a perforated periphery.

14. The container of claim 12 wherein said venting means comprises one of said side walls having an opening near said bottom wall.

15. A fuel package comprising:

a rectangular container having four side walls, a bottom wall and a top wall, one of side walls having an orifice near said bottom wall for receiving incoming oxygen-rich air, said top wall comprising first, second, third, and fourth flaps, said flaps selectively foldable about an edge to close said container, said first flap having a pull tab which is selectively displaceable from a plane of said first flap, at least one of said second, third, or fourth flaps having a void disposed beneath said pull tab when said flaps are folded to close said container;

a charge of charcoal within said container;

an ignitor element within said container, and, a wick extending from without said container to said ignitor element.

16. The container of claim 1 wherein said plurality of planar surfaces comprise a single continuous element.

17. The container of claim 1 wherein said plurality of planar surfaces are formed by folding a larger, continuous element.

18. A method for constructing a fuel package said method comprising the steps of:

folding a continuous element into a container comprising a plurality of planar surfaces, said planar surfaces comprising four side walls, a top wall and a bottom wall;

securing one of each of said side walls to another of said side walls;

folding and sealing said bottom wall to a closed position;

inserting a floor insert into said container, said floor insert having an ignitor and wick attached thereto and laying flat on said bottom wall of said container;

inserting a charge of fuel into said container;

folding said top wall to a closed position; and, sealing said top wall to retain a closed-position.

19. The fuel package of claim 5 wherein said wick comprises, in weight percent, from about 10 to about 40 percent of an oxidizer, from about 5 to about 30 percent aluminum, from about 10 to about 40 percent iron, from about 5 to about 40 percent silicon, and from about 10 to about 40 percent resinous binder material.

20. The fuel package of claim 19 wherein said oxidizer is a compound selected from the group consisting of potassium perchlorate, potassium chlorate, potassium nitrate, sodium nitrate, and magnesium dioxide.

21. The fuel package of claim 20 wherein said oxidizer is potassium perchlorate.

22. The fuel package of claim 20 wherein said oxidizer is present in an amount ranging from about 30 to about 60 percent of stoichiometric based upon the amount of metal present in said wick composition.

23. The fuel package of claim 15 wherein said wick comprises, in weight percent, from about 10 to about 40 percent of an oxidizer, from about 5 to about 30 percent aluminum, from about 10 to about 40 percent iron, from about 5 to about 40 percent silicon, and from about 10 to about 40 percent resinous binder material.

24. The fuel package of claim 23 wherein said oxidizer is a compound selected from the group consisting of potassium perchlorate, potassium chlorate, potassium nitrate, sodium nitrate, and magnesium dioxide.

25. The fuel package of claim 24 wherein said oxidizer is potassium perchlorate.

26. The fuel package of claim 24 wherein said oxidizer is present in an amount ranging from about 30 to about 60 percent of stoichiometric based upon the amount of metal present in said wick composition.

* * * * *